US007274338B2

(12) United States Patent
Ozkar et al.

(10) Patent No.: US 7,274,338 B2
(45) Date of Patent: Sep. 25, 2007

(54) MEANDER LINE CAPACITIVELY-LOADED MAGNETIC DIPOLE ANTENNA

(75) Inventors: Mete Ozkar, Raleigh, NC (US); Gregory Poilasne, San Diego, CA (US)

(73) Assignee: Kyocera Corporation, Kyoto (JP)

( * ) Notice: Subject to any disclaimer, the term of this patent is extended or adjusted under 35 U.S.C. 154(b) by 122 days.

(21) Appl. No.: 11/248,665

(22) Filed: Oct. 12, 2005

(65) Prior Publication Data

US 2007/0080885 A1 Apr. 12, 2007

(51) Int. Cl.
*H01Q 9/16* (2006.01)
*H01Q 7/00* (2006.01)
*H01Q 1/36* (2006.01)

(52) U.S. Cl. ..... 343/793; 343/866; 343/895

(58) Field of Classification Search ..... 343/741, 343/793, 795, 866, 702, 895
See application file for complete search history.

(56) References Cited

U.S. PATENT DOCUMENTS

| | | | | |
|---|---|---|---|---|
| 3,882,506 | A | 5/1975 | Mori et al. | |
| H1571 | H | 8/1996 | Hansen et al. | |
| 6,144,346 | A | 11/2000 | Boy | |
| 6,204,817 | B1 | 3/2001 | Edvardsson | |
| 6,329,955 | B1 * | 12/2001 | McLean et al. | 343/742 |
| 6,456,243 | B1 | 9/2002 | Poilansne et al. | |
| 6,486,848 | B1 | 11/2002 | Poilansne et al. | |
| 6,515,632 | B1 * | 2/2003 | McLean | 343/741 |
| 6,573,867 | B1 | 6/2003 | Desclos et al. | |
| 6,600,450 | B1 | 7/2003 | Efanov et al. | |
| 6,675,461 | B1 | 1/2004 | Rowson et al. | |
| 6,693,599 | B1 | 2/2004 | Chia et al. | |
| 6,697,025 | B2 | 2/2004 | Koyanagi et al. | |
| 6,717,551 | B1 * | 4/2004 | Desclos et al. | 343/700 MS |
| 6,765,846 | B2 | 7/2004 | Saitou et al. | |
| 6,911,940 | B2 * | 6/2005 | Poilasne et al. | 343/700 MS |
| 2006/0038730 | A1 | 2/2006 | Persche | |
| 2006/0055618 | A1 * | 3/2006 | Poilasne et al. | 343/866 |

FOREIGN PATENT DOCUMENTS

| | | |
|---|---|---|
| DE | 8814993 | 3/1989 |
| EP | 1134840 | 9/2001 |
| EP | 1217685 | 6/2002 |
| WO | WO 02/071536 | 9/2002 |

* cited by examiner

*Primary Examiner*—Shih-Chao Chen

(57) ABSTRACT

A meander line capacitively-loaded magnetic dipole antenna is disclosed. The antenna includes a transformer loop having a balanced feed interface, and a meander line capacitively-loaded magnetic dipole radiator. The meander line capacitively-loaded magnetic dipole radiator also includes an electric field bridge. For example, the meander line capacitively-loaded magnetic dipole radiator may include a quasi loop with a first end and a second end, with the electric field bridge interposed between the quasi loop first and second ends. The electric field bridge may be an element such as a dielectric gap, lumped element, circuit board surface-mounted, ferroelectric tunable, or a microelectromechanical system (MEMS) capacitor. The transformer loop has a radiator interface coupled to a quasi loop transformer interface. In one aspect, the coupled interfaces are a shared perimeter portion shared by both loops.

22 Claims, 8 Drawing Sheets

RECTANGULAR / EQUAL PITCH

RECTANGULAR / EQUAL PITCH / UNEQUAL HEIGHT

ZIG-ZAG SHAPE

ROUND SHAPE

Fig. 15
| Tx BAND | FREE SPACE | PHANTOM HEAD | DIFFERENCE | PHANTOM HAND | DIFFERENCE | PRELIMINARY SAR RESULTS |
|---|---|---|---|---|---|---|
| CONVENTIONAL ANTENNA | 20.8dBm | 14.9dBm | 5.9dB | 17.7dBm | 3.1dB | >1.3W/Kg |
| CAPACITIVELY-LOADED ANTENNA | 20.2dBm | 16.9dBm | 3.3dB | 20.2dBm | 0dB | 0.9W/Kg |
| DIFFERENCE | -0.6 | 2 | 2.6 | 2.6 | 3.1 | -0.4 |
Fig. 16
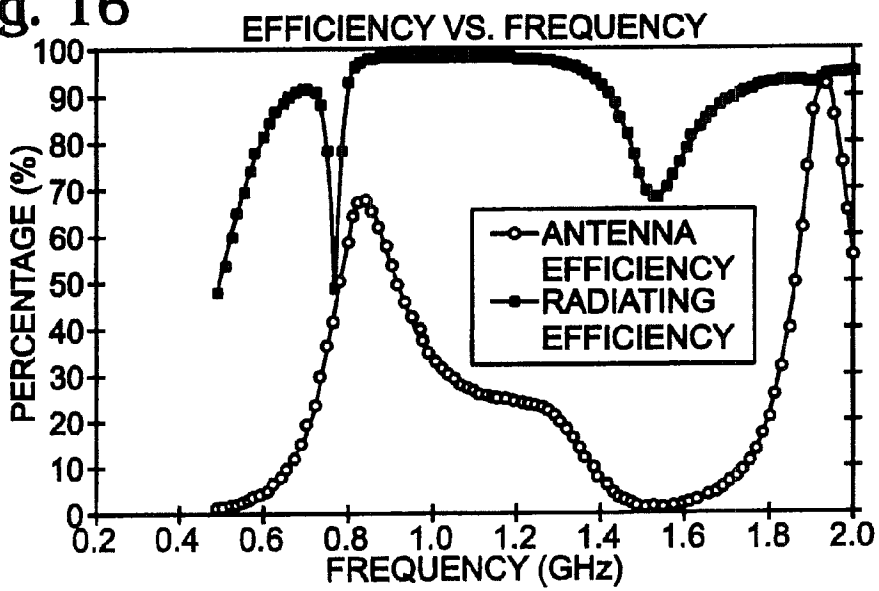
Fig. 14
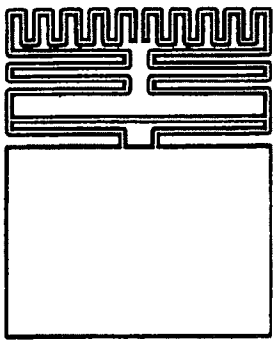

MEANDER LINE CAPACITIVELY-LOADED MAGNETIC DIPOLE ANTENNA

FIELD OF THE INVENTION

This invention generally relates to wireless communications and, more particularly, to a meander line capacitively-loaded magnetic dipole antenna with a balanced feed.

BACKGROUND OF THE INVENTION

The size of portable wireless communications devices, such as telephones, continues to shrink, even as more functionality is added. As a result, the designers must increase the performance of components or device subsystems and reduce their size, while packaging these components in inconvenient locations. One such critical component is the wireless communications antenna. This antenna may be connected to a telephone transceiver, for example, or a global positioning system (GPS) receiver.

State-of-the-art wireless telephones are expected to operate in a number of different communication bands. In the US, the cellular band (AMPS), at around 850 megahertz (MHz), and the PCS (Personal Communication System) band, at around 1900 MHz, are used. Other communication bands include the PCN (Personal Communication Network) and DCS at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575 MHz, Bluetooth at approximately 2400 MHz, and wideband code division multiple access (WCDMA) at 1850 to 2200 MHz.

Wireless communications devices are known to use simple cylindrical coil or whip antennas as either the primary or secondary communication antennas. Inverted-F antennas are also popular. The resonance frequency of an antenna is responsive to its electrical length, which forms a portion of the operating frequency wavelength. The electrical length of a wireless device antenna is often at multiples of a quarter-wavelength, such as $5\lambda 4$, $3\lambda/4$, $\lambda/2$, or $\lambda/4$, where $\lambda$ is the wavelength of the operating frequency, and the effective wavelength is responsive to the physical length of the antenna radiator and the proximate dielectric constant.

Many of the above-mentioned conventional wireless telephones use a monopole or single-radiator design with an unbalanced signal feed. This type of design is dependent upon the wireless telephone printed circuit boards groundplane and chassis to act as the counterpoise. A single-radiator design acts to reduce the overall form factor of the antenna. However, the counterpoise is susceptible to changes in the design and location of proximate circuitry, and interaction with proximate objects when in use, i.e., a nearby wall or the manner in which the telephone is held. As a result of the susceptibility of the counterpoise, the radiation patterns and communications efficiency can be detrimentally impacted.

A balanced antenna, when used in a balanced RF system, is less susceptible to RF noise. Both feeds are likely to pick up the same noise and, thus, be cancelled. Further, the use of balanced circuitry reduces the amount of current circulating in the groundplane, minimizing receiver desensitivity issues.

It would be advantageous if wireless communication device radiation patterns were less susceptible to proximate objects.

It would be advantageous if a wireless communications device could be fabricated with a balanced feed antenna, having a form factor as small as an unbalanced antenna.

SUMMARY OF THE INVENTION

The present invention discloses a capacitively-loaded magnetic dipole radiator antenna. The antenna is balanced, to minimize the susceptibility of the counterpoise to detuning effects that degrade the far-field electro-magnetic patterns. The balanced antenna also acts to reduce the amount of radiation-associated current in the groundplane, thus improving receiver sensitivity. The antenna loop is a capacitively-loaded magnetic dipole, to confine the electric field and so reduce the overall size (length) of the radiating elements. Further, the antenna's radiator is made from a meander line structure, to reduce to overall form factor of the antenna.

Accordingly, a meander line capacitively-loaded magnetic dipole antenna is provided. The antenna comprises a transformer loop having a balanced feed interface, and a meander line capacitively-loaded magnetic dipole radiator. The meander line capacitively-loaded magnetic dipole radiator includes an electric field bridge. For example, the meander line capacitively-loaded magnetic dipole radiator may comprise a quasi loop with a first end and a second end, with the electric field bridge interposed between the quasi loop first and second ends. The electric field bridge may be an element such as a dielectric gap, lumped element, circuit board surface-mounted, ferroelectric tunable, or a micro-electromechanical system (MEMS) capacitor.

The transformer loop has a radiator interface coupled to a quasi loop transformer interface. In one aspect, the coupled interfaces are a perimeter portion shared by both loops. The quasi loop may comprise a first group of substantially parallel lines connected to one end of the shared perimeter, and the second group of substantially parallel lines, orthogonal to the first group of lines, interposed between the first group of lines and one end of the bridge. Likewise, the quasi loop may include a third group of substantially parallel lines connected to the other end of the shared perimeter, and a fourth group of substantially parallel lines, orthogonal to the third group of lines, interposed between the third group of lines and the other end of the bridge.

Additional details of the above-described antenna, a wireless device with a meander line capacitively-loaded magnetic dipole antenna, and a magnetic radiation method insensitive to changes in a proximate dielectric are presented below.

BRIEF DESCRIPTION OF THE DRAWINGS

FIG. 14 is a plan view of a variation of the capacitively-loaded magnetic dipole antenna of FIG. 3.

FIG. 15 is a table comparing the results of a conventional planar invented-F antenna (PIFA) to the capacitively-loaded magnetic dipole antenna of FIG. 14.

FIG. 16 is a plot showing the antenna efficiency and radiating efficiency of the antenna of FIG. 14.

DETAILED DESCRIPTION OF THE PREFERRED EMBODIMENTS

Figure 1:
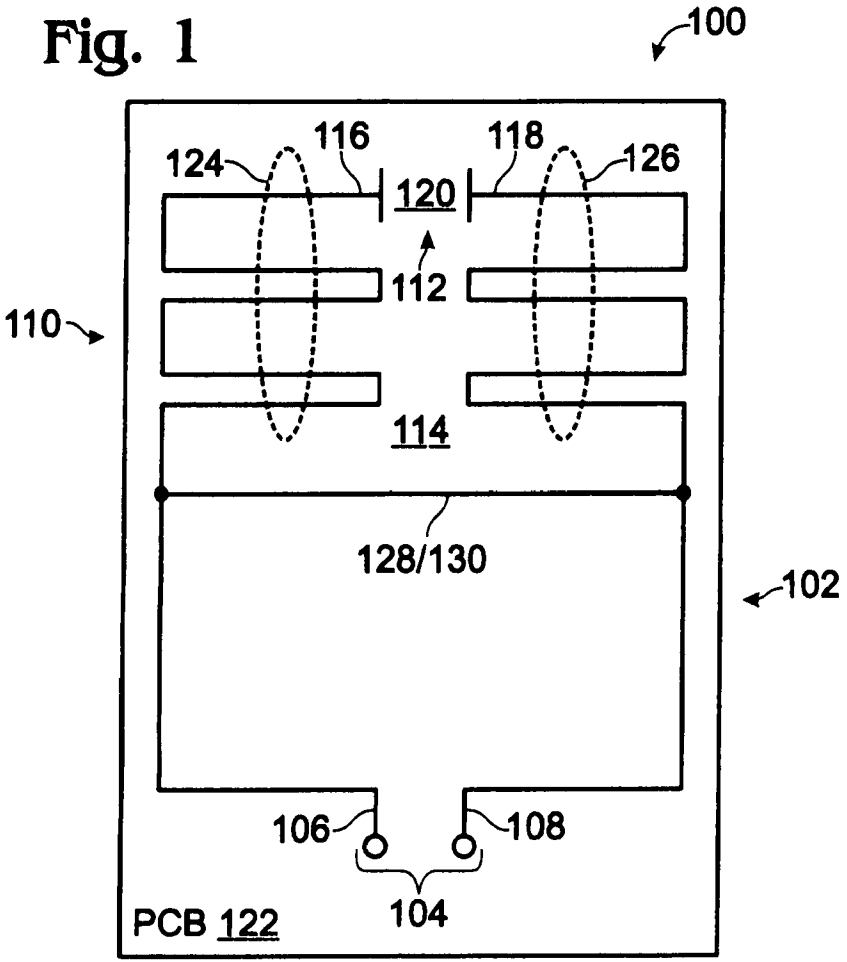
FIG. 1 is a plan view of a meander line capacitively-loaded magnetic dipole antenna.

FIG. 1 is a plan view of a meander line capacitively-loaded magnetic dipole antenna. The antenna 100 comprises a transformer loop 102 having a balanced feed interface 104. The balanced feed interface 104 accepts a positive signal on line 106 and a negative signal (considered with respect to the positive signal) on line 108. In some aspects, the signal on line 108 is 180 degrees out of phase with the signal on line 106. The antenna 100 also comprises a meander line capacitively-loaded magnetic dipole radiator 110.

The meander line capacitively-loaded magnetic dipole radiator 110 comprises an electric field bridge 112. The meander line capacitively-loaded magnetic dipole radiator 110 comprises a quasi loop 114 with a first end 116 and a second end 118. The electric field bridge 112 is interposed between the quasi loop first end 116 and the second end 118. As shown, the bridge 112 is a dielectric gap capacitor, where the dielectric is the material 120 in the bridge. For example, the dielectric material 120 may be air. Alternately, the transformer loop 102 and radiator 110 may be conductive microstrip traces on a printer circuit board (PCB) 122, in which case the dielectric material 120 is primarily the PCB dielectric. However enabled, the bridge 112 acts to confine an electric field.

The antenna 100 of FIG. 1 can be understood as a confined electric field magnetic dipole antenna. That is, the antenna can be considered as comprising a quasi loop 114 acting as an inductive element, and a bridge 112 that confines an electric field between the quasi loop first and second end sections 116/118. The magnetic dipole radiator 110 can be a balanced radiator, or quasi-balanced. Unlike conventional dipole antennas, which operate by generating an electric field (E-field) between radiators, a capacitively-loaded magnetic dipole operates by generating a magnetic field (H-field) through the quasi loop 114. The bridge 112, or confined electric field section, couples or conducts substantially all the electric field between first and second end sections 116/118. As used herein, "confining the electric field" means that the near-field radiated by the antenna is mostly magnetic. Thus, the magnetic field that is generated has less of an interaction with the surroundings or proximate objects. The reduced interaction can positively impact the overall antenna efficiency.

In one simple aspect as shown, the quasi loop 114 comprises a first group of substantially parallel meander lines 124 (circled with a phantom line for reference) and a second group of substantially parallel meander lines 126 (circled with a phantom line for reference). As used herein, the lines are considered to be substantially parallel if the majority of the overall line length is formed as parallel running lines. As shown, the first group of meander lines 124 is about orthogonal to the second group of meander lines 126. However, the lines in the first group 124 (or second group 126) need not be parallel. Likewise, the relationship between the first group 124 and second group 126 need not be orthogonal. Other aspects of the antenna are presented below.

The transformer loop 102 has a radiator interface 128. Likewise, the quasi loop 114 has a transformer interface 130 coupled to the transformer loop radiator interface 128. As shown, the interfaces 128 is a first side of the transformer loop 102, and the quasi loop 114 has a perimeter that shares the first side 128 with the transformer loop 102. That is, interfaces 128 and 130 are a shared perimeter portion from both the transformer loop 112 and the quasi loop 114. However, as presented below, there are other means of coupling the transformer loop 102 to the quasi loop 114.

For simplicity the invention will be described in the context of rectangular-shaped loops. However, the transformer loop 102 and quasi loop 114 are not limited to any particular shape. For example, in other variations not shown, the transformer loop 102 and quasi loop 114 may be substantially circular, oval, shaped with multiple straight sections (i.e., a pentagon shape). Further, the transformer loop 102 and quasi loop 114 need not necessary be formed in the same shape. Even if the transformer loop 102 and the quasi loop 110 are formed in substantially the same shape, the perimeters or areas surrounded by the perimeters need not necessarily be the same.

Figure 2A:
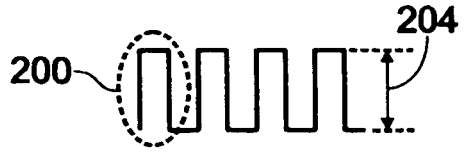
FIGS. 2A through 2E are plan drawings depicting different meander line variations.

FIGS. 2A through 2E are plan drawings depicting different meander line variations. As shown in FIG. 2A, the quasi loop meander line may comprise a plurality of sections having a shape 200, a pitch 202, a height, 204, and an offset 206. As shown in FIG. 2A, the shape 200 is rectangular, the pitch is equal (there is no pitch), the height 204 is equal (uniform), and there is no offset.

Figure 2B:
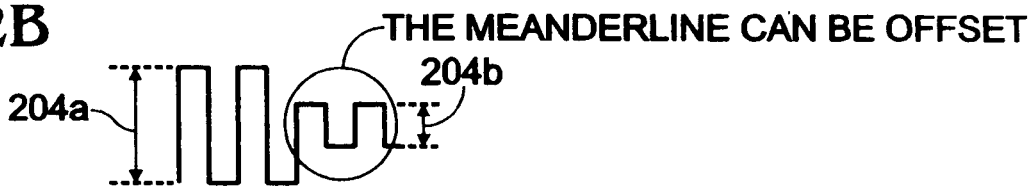

FIG. 2B shows a meander line with a rectangular shape, an equal pitch, an unequal heights 204*a* and 204*b*, with no offset.

Figure 2C:
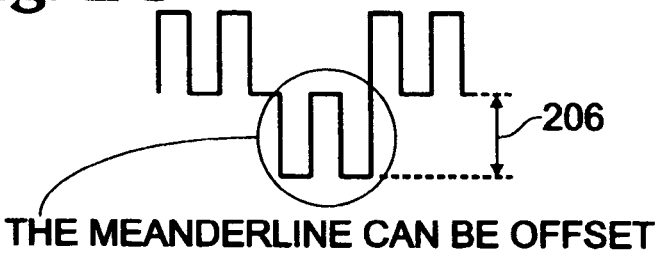

FIG. 2C shows a meander line with a rectangular shape, an equal pitch, an equal height, with an offset 206.

Figure 2D:
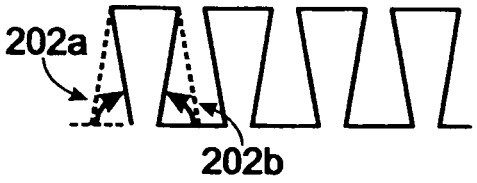

FIG. 2D shows a meander line with a zig-zag shape, a pitch 202*a* and 202*b*, an equal height, with no offset.

Figure 2E:
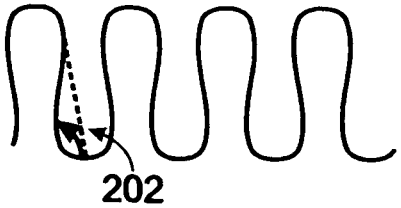

FIG. 2E shows a meander line with a round shape, a pitch 202, an equal height, with no offset.

As is well understood in the art, meander line radiators are an effective way of forming a relatively long effective electrical quarter-wavelength, for relatively low frequencies. The summation of all the sections contributes to the overall length of the meandering line. The meander line described herein is not necessarily limited to any particular shape, pattern, pitch, height, offset, or length.

Figure 3:
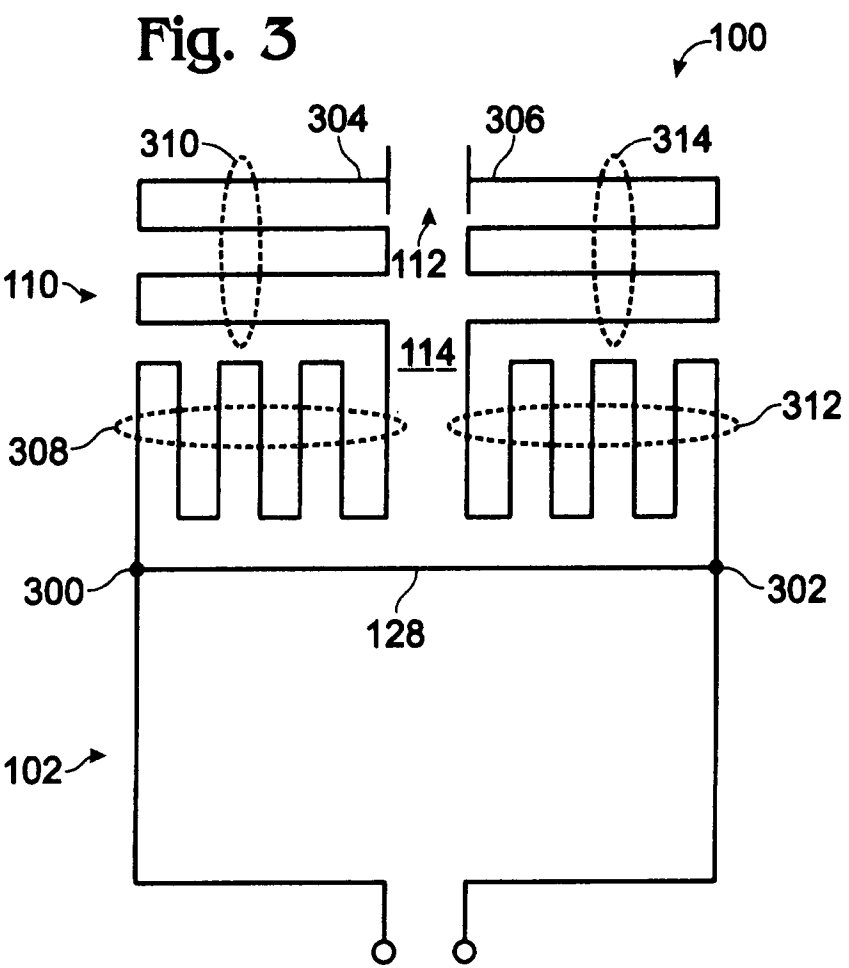
FIG. 3 is a plan drawing depicting a first variation of the capacitively-loaded magnetic dipole antenna of FIG. 1.

FIG. 3 is a plan drawing depicting a first variation of the capacitively-loaded magnetic dipole antenna of FIG. 1. In this aspect the transformer loop first side 128 has a first end 300 and second end 302. The electric field bridge 112 has a first end 304 and a second end 306. The quasi loop 114 has the first group of substantially parallel lines 308 connected to the first end 300 of the first side 128, and the second group of substantially parallel lines 310, about orthogonal to the first group of lines 308. The second group of lines 310 is interposed between the first group of lines 308 and the bridge first end 304.

Likewise, the quasi loop 114 has a third group of substantially parallel lines 312 connected to the second end 302 of the first side 128. A fourth group of substantially parallel lines 314, about orthogonal to the third group of lines 312, is interposed between the third group of lines 312 and the bridge second end 306. As shown, the quasi loop third group of lines 312 is about parallel to the first group of lines 308, and the fourth group of lines 314 is about parallel to the second group of lines 310. However, other relationships can be formed between the third group of lines 312 and the first group of lines 308, as well as between the fourth group of lines 314 and the second group of lines 310.

In another aspect, the meander line capacitively-loaded magnetic dipole radiator 110 resonates at a first frequency and at a second frequency, non-harmonically related to the first frequency. The ability of the antenna 100 to resonant at two non-harmonically related frequency is a result of the placement of the first (third) group of lines 308 with respect to the second (fourth) group 310.

Figure 4A:
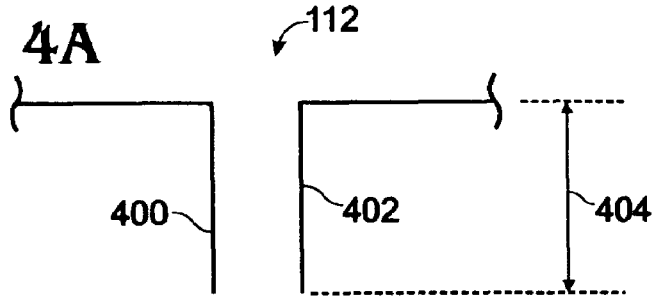
FIGS. 4A through 4E depicts alternate variations of an electric field bridge.

FIGS. 4A through 4E depicts alternate variations of an electric field bridge. In FIG. 4A, the bridge 112 is shown as a dielectric gap capacitor. Here, the bridge first end section 400 is about parallel to a second end section 402, and equal in length 404. However, other arrangements are possible between the bridge first end 400 and bridge second end 402. Alternately but not shown, the bridge may be an interdigital gap capacitor.

Figure 4B:
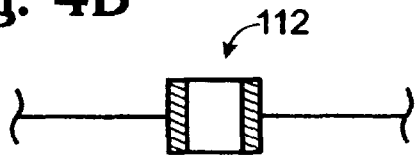
Figure 4C:
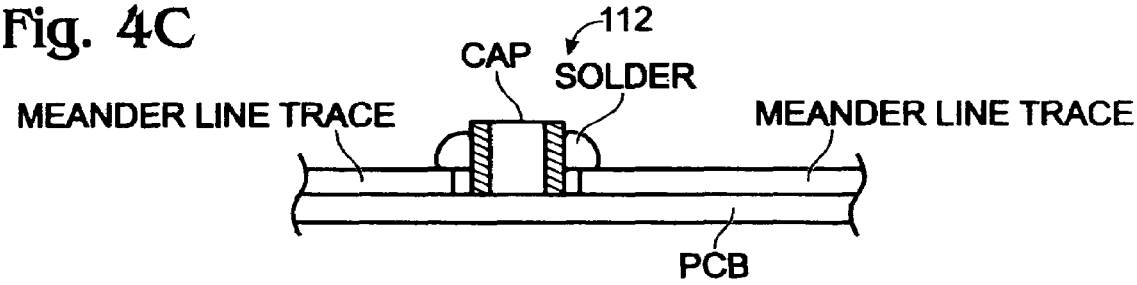
Figure 4D:
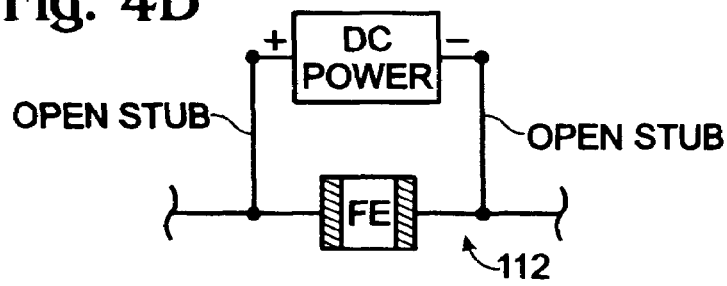
Figure 4E:
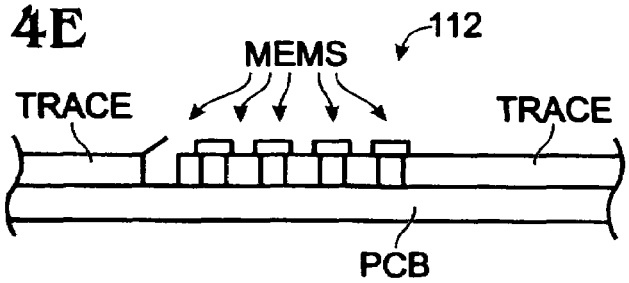

In FIG. 4B, the bridge 112 is shown as a lumped element capacitor. In FIG. 4C, the bridge 112 is shown as a surface-mounted capacitor. In FIG. 4D, the bridge is shown as a ferroelectric (FE) tunable capacitor. In FIG. 4E, the bridge is shown as a microelectromechanical system (MEMS) dielectric gap capacitor formed from selectively connected conductive sections, to create gaps of different sizes.

Figure 5:
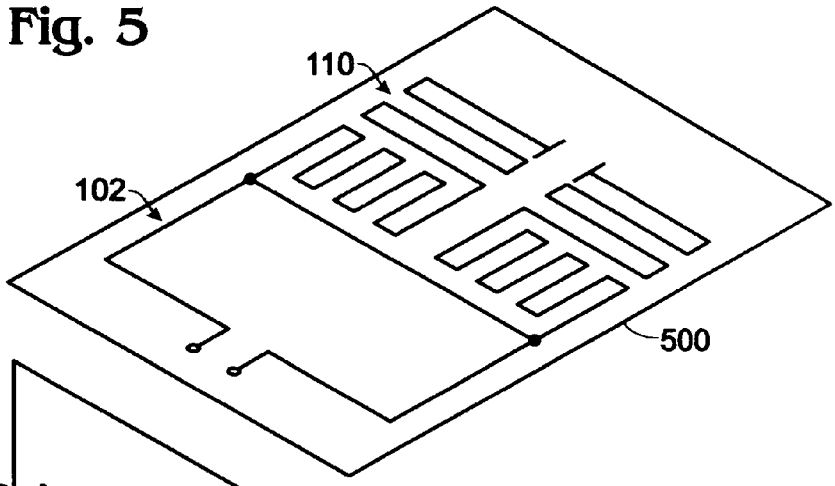
FIG. 5 is a perspective view of a coplanar version of the antenna of FIG. 1.

FIG. 5 is a perspective view of a coplanar version of the antenna of FIG. 1. As shown, the transformer loop 102 and the meander line capacitively-loaded magnetic dipole radiator 110 are coplanar. That is, the transformer loop 102 and the capacitively-loaded magnetic dipole radiator 110 are in the same plane 500. However, as described below, other planar arrangements are possible.

Figure 6:
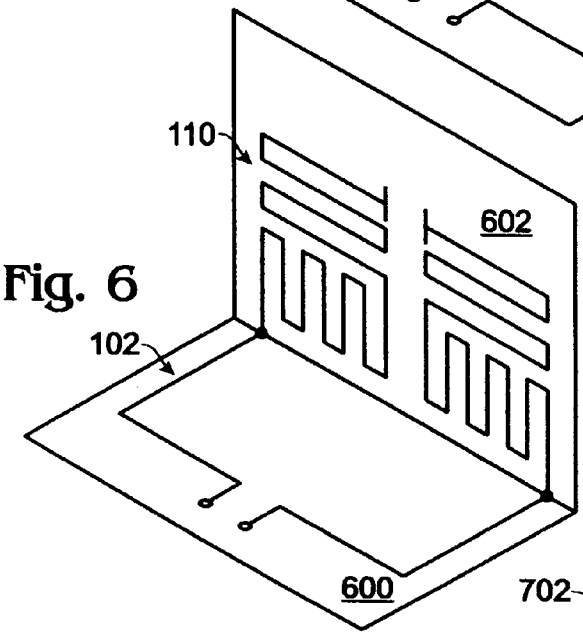
FIG. 6 is a perspective view of a non-coplanar variation of the antenna of FIG. 1.

FIG. 6 is a perspective view of a non-coplanar variation of the antenna of FIG. 1. In this aspect, the transformer loop 102 and the meander line capacitively-loaded magnetic dipole radiator 110 are non-coplanar. That is, the transformer loop 102 is in a first plane 600 and the capacitively-loaded magnetic dipole 110 is in a second plane 602. As shown, the first plane 600 is about orthogonal to the second plane 602. However, other planar relationships are possible.

Figure 7:
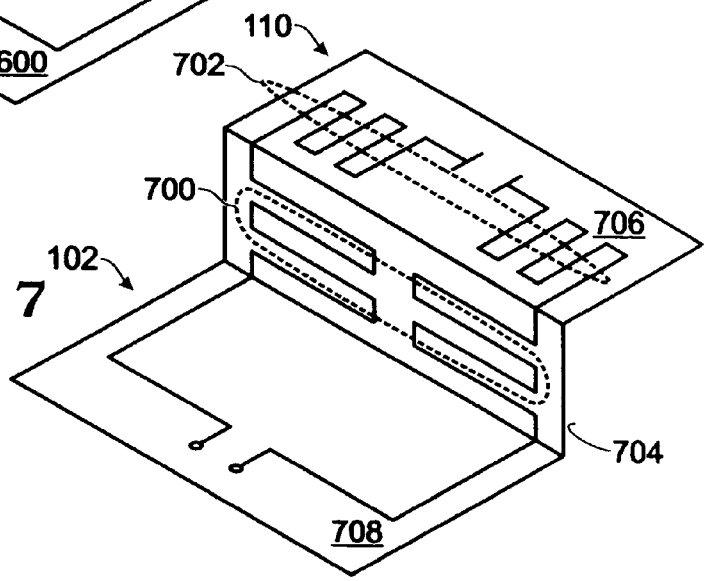
FIG. 7 is a perspective view of a variation of the antenna of FIG. 3.

FIG. 7 is a perspective view of a variation of the antenna of FIG. 3. Not only may the transformer loop 102 and magnetic dipole radiator 110 be in different planes (see FIG. 6), the capacitively-loaded magnetic dipole radiator 110 (or the transformer loop 102) may be comprised on non-coplanar sections. As shown in FIG. 7, a quasi loop first group of lines 700, in plane 704, is non-coplanar with a second group of lines 702, in plane 706. The transformer loop 102 is in plane 708. Again, the two planes 706 and 708 are shown as about orthogonal, however, other planar relationships are possible. Although not shown, the transformer loop may also be formed in non-coplanar sections.

Further, the capacitively-loaded magnetic dipole radiator 110 may be formed in a plurality of planar sections (not shown). Further, each planar sections may be curved, bowed, or shaped. In summary, it should be understood that the antenna is not confined to any particular shape, but may be conformed to fit on or in an object, such as a cellular telephone housing.

Figure 8:
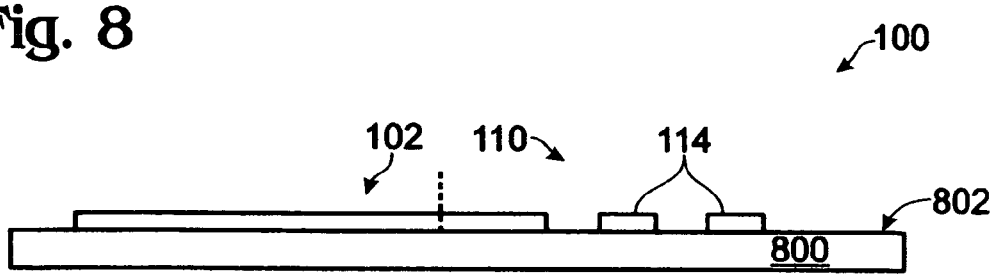
FIG. 8 is a partial cross-sectional view depicting a microstrip variation of the antenna of FIG. 1.

FIG. 8 is a partial cross-sectional view depicting a microstrip variation of the antenna of FIG. 1. The antenna further comprises a sheet of dielectric material 800 with a surface 802. The transformer loop 102 and meander line capacitively-loaded quasi loop 114 are metal conductive traces (i.e., 0.5 ounce copper, silver, conductive ink, or tin) formed overlying the surface 802 of the dielectric sheet 800. The dielectric sheet 800 can be a material such as paper, polyester, polyimide, synthetic aromatic polyamide polymer, phenolic, polytetrafluoroethylene (PTFE), chlorosulfonated polyethylene, silicon, or ethylene propylene diene monomer (EPDM). In addition, the dielectric sheet may be any conventional PCB material, such as FR4 or higher dielectric materials conventionally used in radio frequency (RF) circuit boards.

Figure 9:
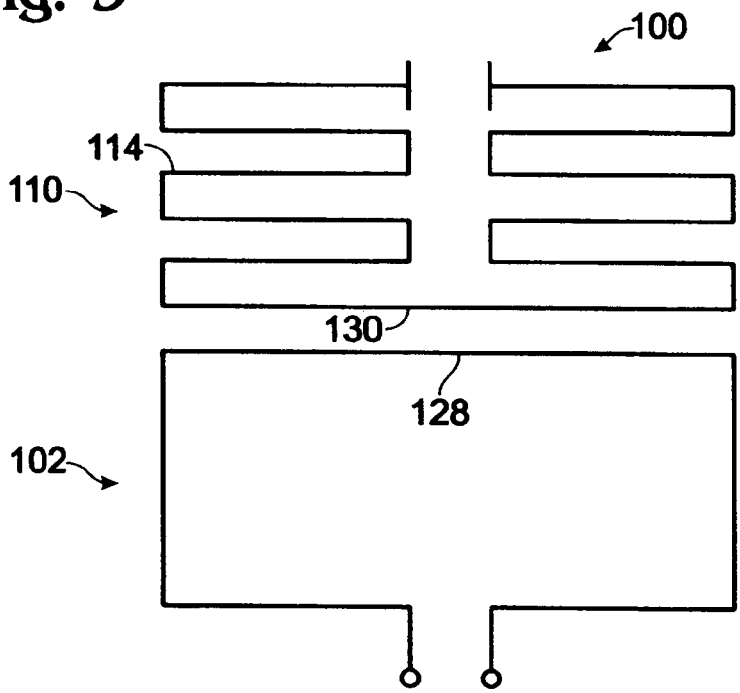
FIG. 9 is plan view of a physically independent loop variation of the antenna of FIG. 1.

FIG. 9 is plan view of a physically independent loop variation of the antenna of FIG. 1. In this variation, the transformer loop 102 and capacitively-loaded magnetic dipole radiator 110 are not physically connected. Alternately stated, the transformer loop 102 and quasi loop 114 do not share any electrical current, as interfaces 128 and 130 do not touch. As shown, the transformer loop 102 perimeter is physically independent of the quasi loop 114 perimeter.

Figure 10:
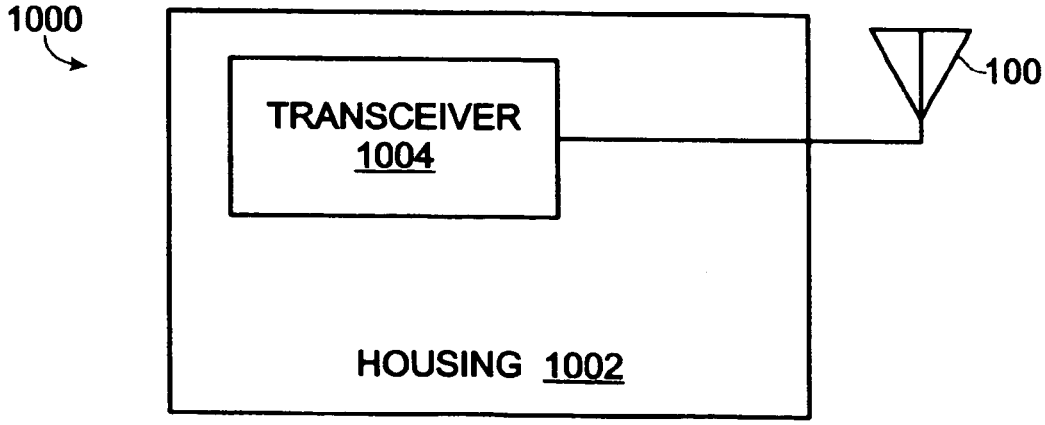
FIG. 10 is a schematic block diagram of a wireless telephone communications device capacitively-loaded magnetic dipole antenna.

FIG. 10 is a schematic block diagram of a wireless telephone communications device capacitively-loaded magnetic dipole antenna. The device 1000 comprises a housing 1002 and a telephone transceiver 1004 embedded in the housing 1002. A balanced feed meander line capacitively-loaded magnetic dipole antenna 100 is embedded in the housing 1002. As explained in more detail below, the capacitively-loaded magnetic dipole antenna 100 has a radiation efficiency that is insensitive to the proximity of the placement of a user's hand on the housing 1002.

The invention is not limited to any particular communication format, i.e., the format may be Code Division Multiple Access (CDMA), Global System for Mobile Communications (GSM), or Universal Mobile Telecommunications System (UMTS). Neither is the device 1000 limited to any particular range of frequencies. Details of the antenna 100 are provided in the explanations of FIGS. 1 through 9, above, and will not be repeated in the interests of brevity. Note, the invention is also applicable to other portable wireless devices, such as two-way radios, GPS receivers, Wireless Local Area Network (WLAN) transceivers, to name a few of examples.

Figure 11:
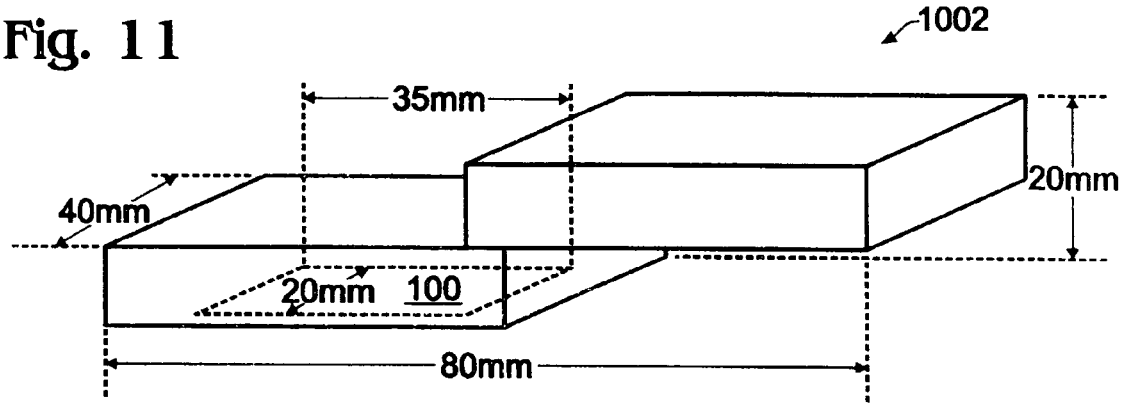
FIG. 11 is a first perspective view of the wireless device of FIG. 10.

FIG. 11 is a first perspective view of the wireless device of FIG. 10. In this aspect, the housing is a two-part configuration such as a flip, slider, or swivel cellular telephone. In either the open or closed configuration, the above-mentioned housings all share about the same form factor, with the difference being in the hinge/opening mechanism. In the open configuration (as shown) the housing has the dimensions of about 40 by 80 by 20 millimeters (mm), or greater. The antenna 100, shown in phantom) has dimensions of about 35 mm by 20 mm by 0.05 micrometers, or greater.

Figure 12:
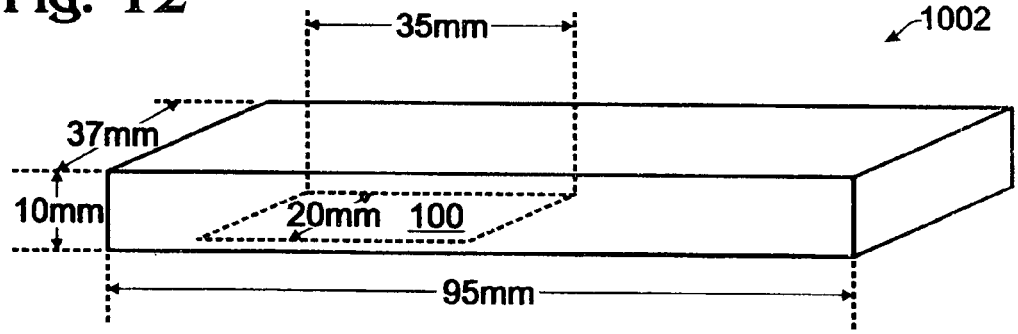
FIG. 12 is a second perspective view of the wireless device of FIG. 10.

FIG. 12 is a second perspective view of the wireless device of FIG. 10. In this aspect, the housing 1002 is a "candy bar" cellular telephone with dimensions of about 95 by 37 by 10 mm, or greater. Again, the antenna 100 has dimensions of about 35 mm by 20 mm by 0.05 micrometers, or greater.

Functional Description

Balanced antennas do not make use of the ground plane in order to radiate. This means that a balanced antenna can be located in a very thin wireless device, without detrimental affecting radiation performance. In fact, the antenna can be located within about 2 to 3 mm of a groundplane with no noticeable effect upon performance. The antenna is also less sensitive to currents on the ground plane, such as noise currents, or currents that are related to Specific Absorption Rate (SAR). Since the antenna can be made coplanar, it can be realized on a flex film, for example, at a very low cost.

Figure 13:
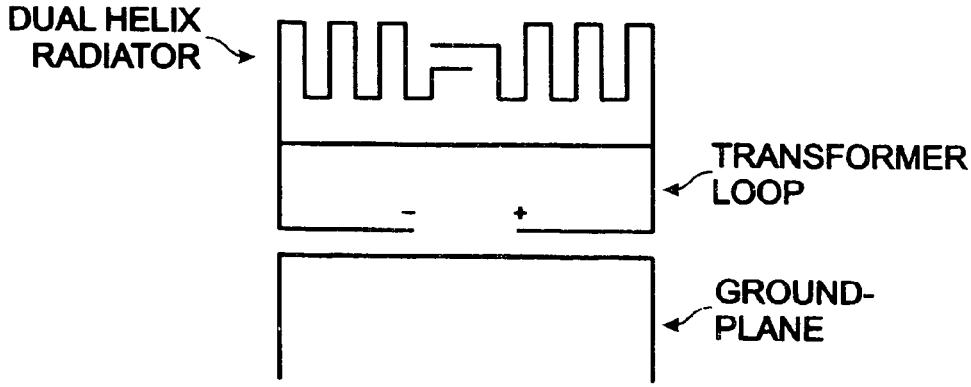
FIG. 13 is a plan view of a dual helix variation of the antenna of FIG. 1.

FIG. 13 is a plan view of a dual helix variation of the antenna of FIG. 1. As in FIG. 1, the radiator quasi loop may be matched to low impedances with the addition of a transformer loop.

FIG. 14 is a plan view of a variation of the capacitively-loaded magnetic dipole antenna of FIG. 3. The antenna's transformer loop is matched into a balun built from lump elements (12 nH and 3 pF). Without the balun, the antenna efficient is measured to be about 45% efficient. With the balun, the same antenna is about 70% efficient at the radiating frequency.

FIG. 15 is a table comparing the results of a conventional planar invented-F antenna (PIFA) to the capacitively-loaded magnetic dipole antenna of FIG. 14. The results are measured at while transmitted at approximately 824 MHz. The results show that while the capacitively-loaded magnetic dipole antenna performs slightly poorer in free space (0.6 dB), it outperforms the PIFA by 2.6 db in the proximity of a phantom head, and 3.1 db in proximity to a phantom hand. If fact, it is significant that no change in the performance of the capacitively-loaded magnetic dipole can be measured while simulating the effects of a user's hand.

FIG. 16 is a plot showing the antenna efficiency and radiating efficiency of the antenna of FIG. 14. Antenna efficiency includes all types of loss, including voltage standing wave ratio (VSWR) and loss in material. Radiation efficiency corresponds to the efficiency of a perfectly matched antenna.

Figure 17:
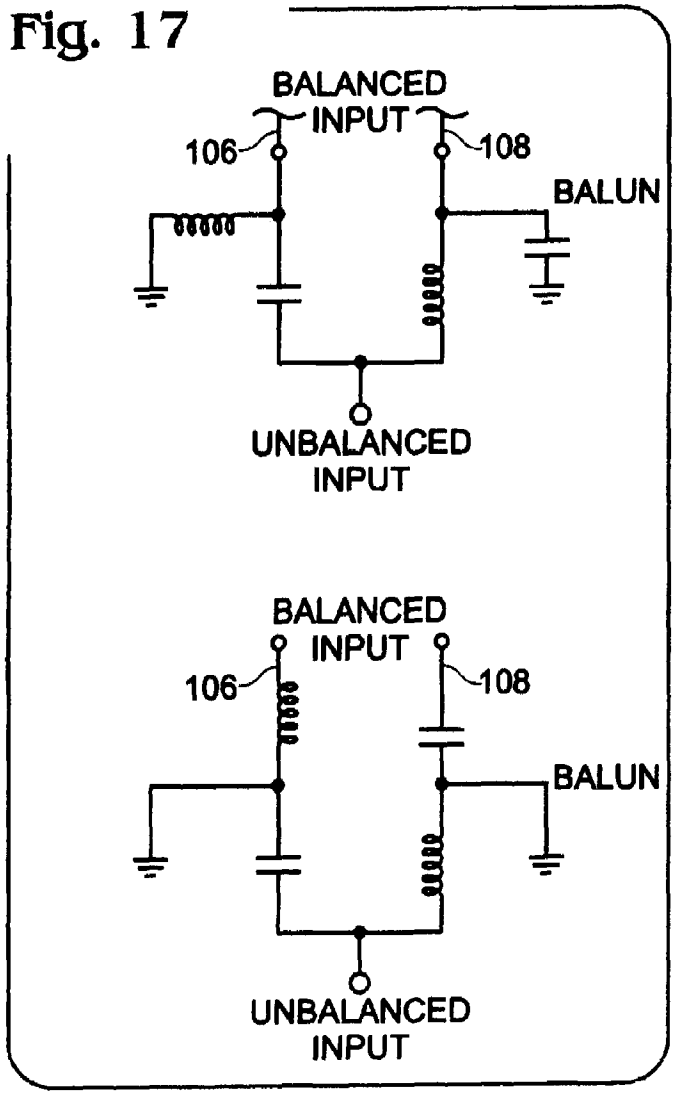
FIG. 17 is a schematic diagram depicting two different balun configurations that can be used to supply a balanced feed input to the transformer loop of the capacitively-loaded magnetic dipole antenna.

FIG. 17 is a schematic diagram depicting two different balun configurations that can be used to supply a balanced feed to the transformer loop inputs 106 and 108 of the capacitively-loaded magnetic dipole antenna, from an unbalanced feed such as a coaxial cable.

Figure 18:
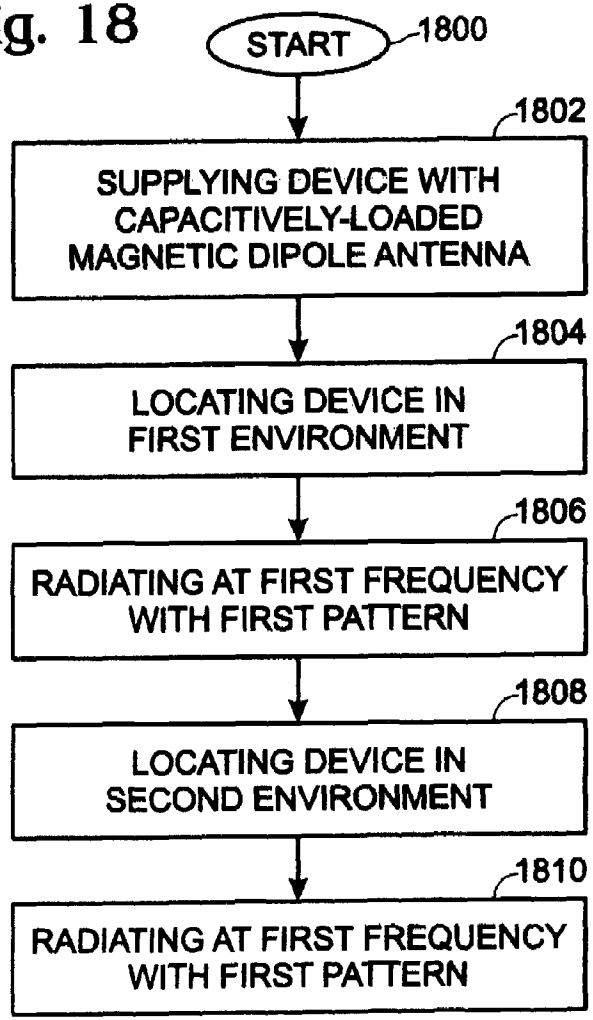
FIG. 18 is a flowchart illustrating the present invention magnetic radiation method that is insensitive to changes in a proximately located dielectric.

FIG. 18 is a flowchart illustrating the present invention magnetic radiation method that is insensitive to changes in a proximately located dielectric. Although the method is depicted as a sequence of numbered steps for clarity, no order need be inferred from the numbering. It should be understood that some of these steps may be skipped, performed in parallel, or performed without the requirement of maintaining a strict order of sequence. The method starts at Step 1800.

Step 1802 supplies a wireless communications device with a meander line capacitively-loaded magnetic dipole antenna. Step 1804 locates the device in a first environment with a first dielectric constant. Step 1806 radiates at a first frequency with a first radiation pattern in the first environment. Step 1808 locates the device in a second environment with a second dielectric constant, different than the first dielectric constant. Step 1810 continues to radiate at the first frequency with the first radiation pattern in the second environment.

In one aspect, supplying the wireless communications device with the capacitively-loaded magnetic dipole antenna in Step 1802 includes supplying a cellular telephone (see FIG. 10), and radiating at the first frequency (Step 1806) includes radiating at a frequency of about 800 MHz. Locating the device in the first environment in Step 1804 includes locating the cellular telephone in free space, while locating the device in the second environment (Step 1808) includes contacting the cellular telephone with a human hand. Then, continuing to radiate at the first frequency with the first radiation pattern in Step 1810 includes radiating the first radiation pattern with about a 0 dB loss in the hand-proximate environment, as compared to the free space environment.

A balanced feed, meander line capacitively-loaded magnetic dipole antenna has been provided. Some specific examples of loop shapes, loop orientations, bridge and electric field confining sections, physical implementations, and uses have been given to clarify the invention. However, the invention is not limited to merely these examples. Other variations and embodiments of the invention will occur to those skilled in the art.

What is claimed is:

1. A meander line capacitively-loaded magnetic dipole antenna, the antenna comprising:

a transformer loop having a balanced feed interface; and, a meander line capacitively-loaded magnetic dipole radiator connected to the transformer loop and comprising a first group of substantially parallel meander lines and a second group of substantially parallel meander lines.

2. The antenna of claim 1 wherein the meander line capacitively-loaded magnetic dipole radiator comprises an electric field bridge.

3. The antenna of claim 2 wherein the meander line capacitively-loaded magnetic dipole radiator comprises a quasi loop with a first end and a second end, the quasi loop comprising the first group of substantially parallel meander lines and, the second group of substantially parallel meander lines.

4. The antenna of claim 3 wherein the electric field bridge is interposed between the quasi loop first and second ends.

5. The antenna of claim 3 wherein the electric field bridge is an element selected from the group consisting of a dielectric gap, lumped element, circuit board surface-mounted, ferroelectric tunable, and a microelectromechanical system (MEMS) capacitor.

6. The antenna of claim 3 wherein the electric field bridge is a dielectric gap capacitor with a first end section about parallel to a second end section.

7. The antenna of claim 4 wherein the transformer loop has a radiator interface; and, wherein the quasi loop has a transformer interface coupled to the transformer loop radiator interface.

8. The antenna of claim 7 wherein the transformer loop has a first side; and, wherein the quasi loop has a perimeter that shares the first side with the transformer loop.

9. The antenna of claim 8 wherein the transformer loop first side has a first end and second end;

wherein the electric field bridge has a first end and a second end;

wherein the first group of substantially parallel lines is connected to the first end of the first side and the second group of substantially parallel lines is about orthogonal to the first group of lines and interposed between the first group of lines and the bridge first end; and, wherein the quasi loop comprises a third group of substantially parallel lines connected to the second end of the first side, and a fourth group of substantially parallel lines, about orthogonal to the third group of lines, interposed between the third group of lines and the bridge second end.

10. The antenna of claim 9 wherein the quasi loop third group of lines is about parallel to the first group of lines, and the fourth group of lines is about parallel to the second group of lines.

11. The antenna of claim 9 wherein the meander line capacitively-loaded magnetic dipole radiator resonates at a first frequency and at a second frequency, non-harmonically related to the first frequency.

12. The antenna of claim 4 wherein the quasi loop first group of lines are non-coplanar with the second group of lines.

13. The antenna of claim 1 wherein the first group of meander lines is about orthogonal to the second group of meander lines.

14. The antenna of claim 1 wherein the transformer loop and the meander line capacitively-loaded magnetic dipole radiator are coplanar.

15. The antenna of claim 1 wherein the transformer loop and the meander line capacitively-loaded magnetic dipole radiator are non-coplanar.

16. The antenna of claim 1 further comprising:

a sheet of dielectric material with a surface; and, wherein the transformer loop and capacitively-loaded magnetic dipole quasi loop are metal conductive traces formed overlying the surface of the dielectric sheet.

17. The antenna of claim 16 wherein the dielectric sheet is a material selected from the group comprising paper, polyester, polyimide, synthetic aromatic polyamide polymer, phenolic, polytetrafluoroethylene (PTFE), chlorosulfonated polyethylene, silicon, and ethylene propylene diene monomer (EPDM).

18. A wireless telephone communications device capacitively-loaded magnetic dipole antenna, the device comprising:

a housing;

a telephone transceiver embedded in the housing; and, a balanced teed meander line capacitively-loaded magnetic dipole antenna embedded in the housing, the antenna comprising:

a transformer loop having a balanced feed interface; and a meander line capacitively-loaded magnetic dipole radiator connected to the transformer loop and comprising a first group of substantially parallel meander lines and a second group of substantially parallel meander lines.

19. The device of claim 18 wherein the capacitively-loaded magnetic dipole antenna has a radiation efficiency that is insensitive to the proximity of the placement of a user's hand on the housing.

20. The device of claim 18 wherein the housing is a two-part configuration selected from the group consisting of a flip, slider, and swivel cellular telephone, with dimensions of about 40 by 80 by 20 millimeters (mm), or greater.

21. The device of claim 18 wherein the housing is a "candy bar" cellular telephone with dimensions of at least about 95 by 37 by 10 mm and the antenna has dimensions of at least 35 mm by 20 mm by 0.05 micrometers.

22. A meander line capacitively-loaded magnetic dipole antenna comprising:

a transformer loop having a balanced feed interface; and a meander line capacitively-loaded magnetic dipole radiator connected to the transformer loop and comprising a plurality of meander line groups, each meander line group comprising a plurality of meander lines.

* * * * *